US009581952B2

(12) United States Patent
Sugaya et al.

(10) Patent No.: US 9,581,952 B2
(45) Date of Patent: Feb. 28, 2017

(54) HUMIDIFICATION DEVICE AND IMAGE FORMING APPARATUS

(71) Applicant: CANON KABUSHIKI KAISHA, Tokyo (JP)

(72) Inventors: Kenjiro Sugaya, Moriya (JP); Kazuhisa Okuda, Tokyo (JP); Koji Takematsu, Abiko (JP); Shutaro Saito, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 32 days.

(21) Appl. No.: 14/602,108

(22) Filed: Jan. 21, 2015

(65) Prior Publication Data

US 2015/0205258 A1 Jul. 23, 2015

(30) Foreign Application Priority Data

Jan. 23, 2014 (JP) ..... 2014-010704
Nov. 28, 2014 (JP) ..... 2014-242590

(51) Int. Cl.
*G03G 15/00* (2006.01)

(52) U.S. Cl.
CPC ..... *G03G 15/6576* (2013.01)

(58) Field of Classification Search
CPC ..... G03G 21/203; G03G 15/6573; G03G 15/6576; G03G 2215/00421; G03G 2215/00426
See application file for complete search history.

(56) References Cited

U.S. PATENT DOCUMENTS

2007/0048048 A1* 3/2007 Kougami et al. ..... 399/341
2009/0003875 A1* 1/2009 Toba ..... G03G 21/1803 399/111
2010/0072692 A1* 3/2010 Iida et al. ..... 271/110
2011/0116852 A1* 5/2011 Ogushi ..... 399/341

FOREIGN PATENT DOCUMENTS

JP 2007-58026 A 3/2007

* cited by examiner

*Primary Examiner* — David Gray
*Assistant Examiner* — Thomas Giampaolo, II
(74) *Attorney, Agent, or Firm* — Canon U.S.A. Inc., IP Division

(57) ABSTRACT

A humidification device for humidifying a sheet, comprising a control unit that rotates a water-supply roller in a separate state where the water-supply roller and a humidification roller are separated from each other.

17 Claims, 8 Drawing Sheets

HUMIDIFICATION DEVICE AND IMAGE FORMING APPARATUS

BACKGROUND OF THE INVENTION

Field of the Invention

The present invention relaters to a humidification device and an image forming apparatus.

Description of the Related Art

An electrophotographic image forming apparatus, such as a copier, a printer, a facsimile machine, and a multifunction peripheral having the functions of these apparatuses, has such a problem that a sheet loses moisture in a thermal fixing step, and thus curls or deforms into a wave form.

Japanese Patent Application Laid-Open No. 2007-58026 discusses a technique of providing water to a sheet after performing fixing processing, as one technique to solve the problem described above. More specifically, an image forming apparatus discussed in Japanese Patent Application Laid-Open No. 2007-58026 includes a pair of porous rollers that conveys a sheet and forms a nip portion, and a water supply roller that comes into contact with the porous roller and supplies water.

This configuration has a problem that, due to the difference in an interval between sheets, the first sheet is provided with a larger amount of water than the second sheet and after. To address this problem, the image forming apparatus discussed in Japanese Patent Application Laid-Open No. 2007-58026 performs a control so that pressure contact between the pair of porous rollers is released in an idling state where no image forming is performed.

However, the configuration discussed in Japanese Patent Application Laid-Open No. 2007-58026, may cause uneven distribution (unevenness) of liquid on a surface of the water-supply roller upon returning from the idling state where no image forming is performed. The uneven distribution is especially likely to occur between portions, on the surface of the water-supply roller, immersed and not immersed in a water-supply container. When a recording medium, which has entered a humidification device, is humidified in the state described above, the recording medium is unevenly humidified in a portion from the leading edge to the trailing edge.

To reduce the uneven distribution of liquid on the surface of the water-supply roller, the water-supply roller may be rotated before the recording medium reaches a nip formed by the pair of porous rollers. However, when the water-supply roller is rotated before the recording medium reaches the nip formed by the pair of porous rollers, the liquid supplied to the pair of porous rollers from the water-supply roller is accumulated in the nip formed by the pair of porous rollers instead of being provided to the recording medium. Thus, there is a problem that when the recording medium is conveyed to the nip formed by the pair of porous rollers in this state, an excessive amount of water is provided to the leading edge side of the recording medium. This problem also occurs when a pair of solid rollers is used instead of a pair of porous rollers.

SUMMARY OF THE INVENTION

The present invention is directed to a humidification device and an image forming apparatus capable of reducing humidification unevenness when a recording medium is humidified.

According to an aspect of the present invention, a humidification device for humidifying a sheet, includes, a pair of humidification rollers configured to come into contact with each other so as to form a nip portion, and configured to humidify the sheet which passes through the nip portion, a water-supply roller configured to rotate while being in contact with the humidification roller so as to supply water to the humidification roller, a switching unit configured to switch a positional relationship between the humidification roller and the water-supply roller between a separate state where the humidification roller and the water-supply roller are separated from each other and a contact state where the humidification roller and the water-supply roller are in contact with each other, a drive unit configured to rotate the water-supply roller, and a control unit configured to control the switching unit and the drive unit, wherein the control unit rotates the water-supply roller in the separate state where the water-supply roller and the humidification roller are separated from each other.

Further features of the present invention will become apparent from the following description of exemplary embodiments with reference to the attached drawings.

DESCRIPTION OF THE EMBODIMENTS (Overall Apparatus Configuration)

<Image Forming Apparatus>

Figure 1:
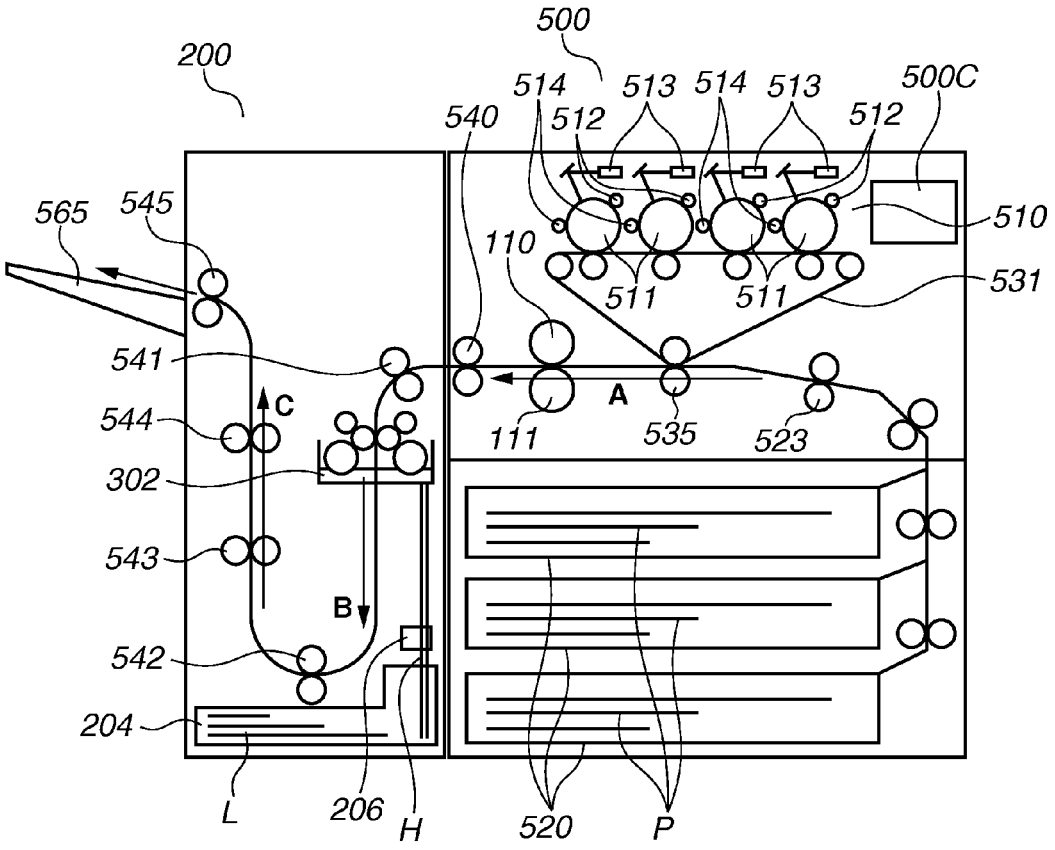
FIG. 1 is a cross-sectional view of an image forming apparatus and a sheet water application apparatus according to a first exemplary embodiment.

A configuration according to a first exemplary embodiment of the present invention will be described with reference to FIGS. 1 to 3. FIG. 1 is a cross-sectional view of an electrophotographic color printer 500, which is an example of an image forming apparatus according to the present exemplary embodiment, taken along a conveyance direction of a sheet. In the present exemplary embodiment, the electrophotographic color printer is simply referred to as a "printer".

A toner image is formed on a sheet. Specific examples of the sheet include plain paper, a resin object in a form of a sheet as a substitute of the plain paper, thick paper, an overhead projector sheet, and the like.

The printer 500 illustrated in FIG. 1 includes image forming units 510 respectively corresponding to yellow (Y), magenta (M), cyan (C), and black (K) colors. Each photosensitive drum 511 is electrostatically charged in advance by a charging roller 512. Then, each laser scanner 513 forms a latent image on the photosensitive drum 511. Each developer 514 develops the latent image into a toner image. The toner images on the respective photosensitive drums 511 are sequentially transferred onto an intermediate transfer belt 531, which is an example of an image-bearing member.

Meanwhile, sheets P are fed from a sheet cassette 520 one by one to be sent to a pair of registration rollers 523. The pair of registration rollers 523, which temporarily receives the sheet P, straightens the sheet P when the sheet P is skewed. Then, the pair of registration rollers 523 sends the sheet P to a portion between the intermediate transfer belt 531 and a secondary transfer roller 535 in synchronization with the toner image on the intermediate transfer belt 531. The color toner image on the intermediate transfer belt 531 is transferred onto the sheet P by the secondary transfer roller 535, which serves as a transfer unit, for example. The toner image that has been transferred onto the sheet P is then heated and pressed to be fixed on the sheet P by a fixing unit 100. Then, the sheet P is sent to a post processing apparatus (sheet water application apparatus) 200 by a main body discharge roller 540.

A fixing roller 110 in FIG. 1 transfers a heat generated by a halogen heater therein (not illustrated) to toner T on the sheet P and conveys the sheet P in cooperation with a pressing roller 111. For example, the fixing roller 110 used herein is formed as follows. Specifically, the halogen heater is mounted in a metal core formed of an aluminum cylindrical tube having an outer diameter of 56 mm and an inner diameter of 50 mm, for example. Then, a surface of the metal core is covered with an elastic layer formed of silicone rubber having a thickness of 2 mm and hardness (Asker C) of 45°, for example. A surface of the elastic layer is further covered with a tetra fluoro ethylene-perfluoro alkylvinyl ether copolymer (PFA) or polytetrafluoroethylene (PTFE) heat-resistant mold release layer.

The pressing roller 111, which conveys the sheet P in cooperation with the fixing roller 112, includes a metal core formed of an aluminum cylindrical tube having an outer diameter of 56 mm and an inner diameter of 50 mm, for example. Then, a surface of the metal core is covered with an elastic layer formed of silicone rubber having a thickness of 2 mm and hardness (Asker C) of 45°, for example. A surface of the elastic layer is further covered with a PFA or PTFE heat-resistant mold release layer.

A fixing nip is formed by the fixing roller 110 and the pressing roller 111. The inventors of the present invention have conducted experiments to find out the following fact. Specifically, when the sheet P is conveyed at a conveyance speed of about 300 to 500 mm/sec under the conditions where a setting temperature of the surface of the fixing roller 110 is 180° C., a setting temperature of the surface of the pressing roller 111 is 100° C., an environmental temperature is 23° C., and an environmental humidity is 50%, the sheet P heated and pressed in the fixing nip receives more heat from the fixing roller 110 at the higher temperature than the pressing roller 111. As a result, the sheet P curls toward the lower side (hereinafter, referred to as lower curl) with fibers of the sheet P extending more on the upper surface side than on the lower surface side. The inventors have also found out that the sheet P deforms into a wave form in the fixing step.

Figure 2:
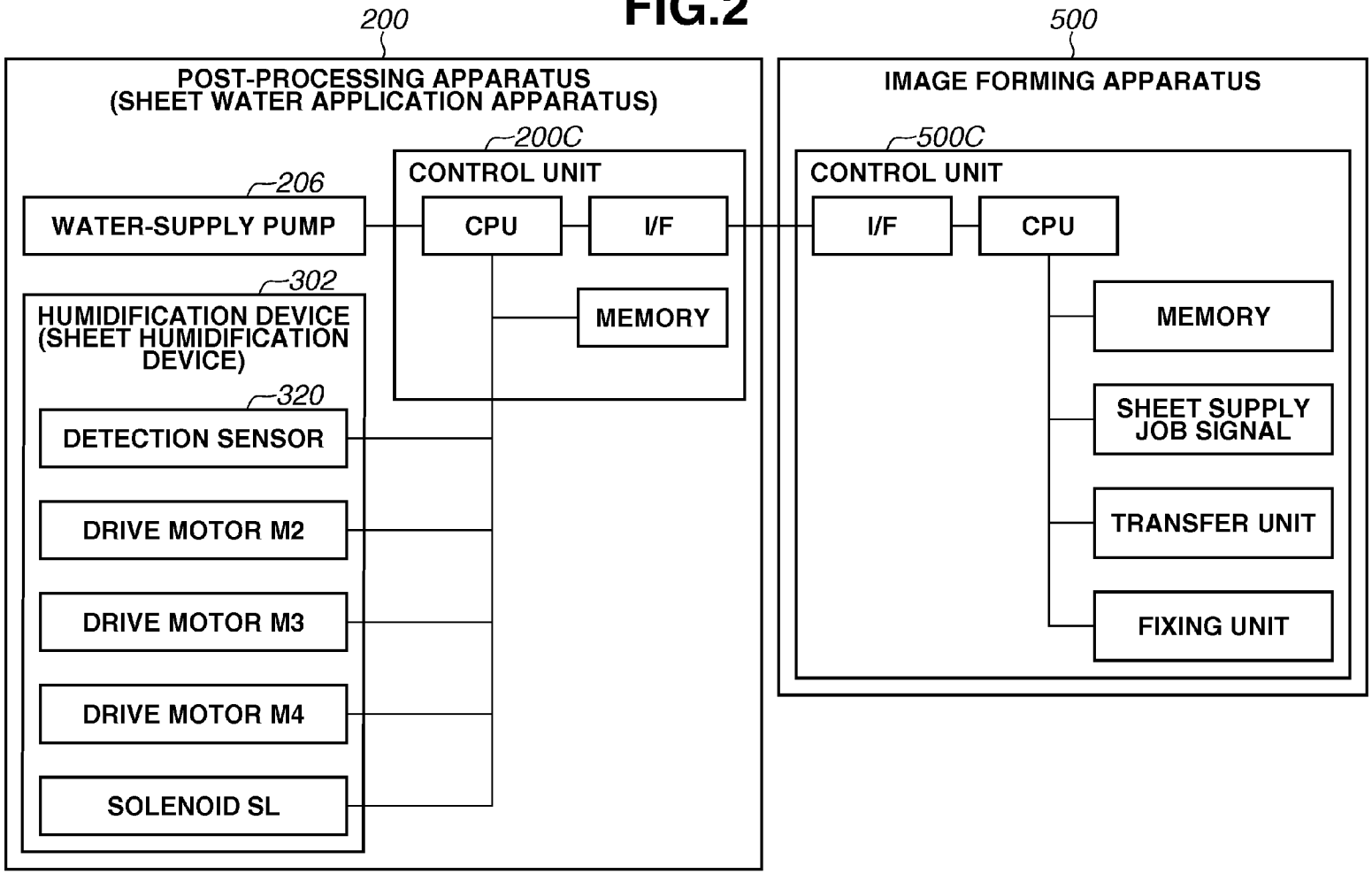
FIG. 2 is a block diagram of the image forming apparatus and the sheet water application apparatus according to the first exemplary embodiment.

FIG. 2 is a block diagram illustrating a control relationship in the entire system including the image forming apparatus (printer) 500 and the post-processing apparatus 200. A control unit 500C of the image forming apparatus 500 and a control unit 200C of the post-processing apparatus 200 are each a computer system including a central processing unit (CPU), a memory, an arithmetic unit, an input/output (I/O) port, a communication interface, a drive circuit, and the like. The control units described above each perform a control by the CPU executing a predetermined program stored in the memory. The control units described above are connected to each other via a communication unit COM, to be capable of exchanging information with each other. In FIG. 2, functional blocks that are not directly related to the description of the present exemplary embodiment are omitted.

FIG. 1 is a cross-sectional view illustrating the entire apparatus system including the image forming apparatus 500 and the post-processing apparatus 200 connected to the image forming apparatus 500. The sheet P with the toner image fixed thereto by being heated and pressed in the fixing unit 100 is conveyed by the main body discharge roller 540 in a direction of an arrow A illustrated in FIG. 1, toward a pair of inlet rollers 541 of the post-processing apparatus 200. Then, the conveyance direction of the sheet P is changed to a vertical lower direction (a direction indicated by an arrow B in FIG. 1). The sheet P is humidified while passing through a humidification device (sheet humidification device) 302 in the course of being conveyed by the pair of inlet rollers 541.

The humidified sheet P is then discharged from the post-processing apparatus 200 by pairs of conveyance rollers 542, 543, 544, and 545 to be stacked on a discharge tray 565.

<Humidification Device>

Figure 4:
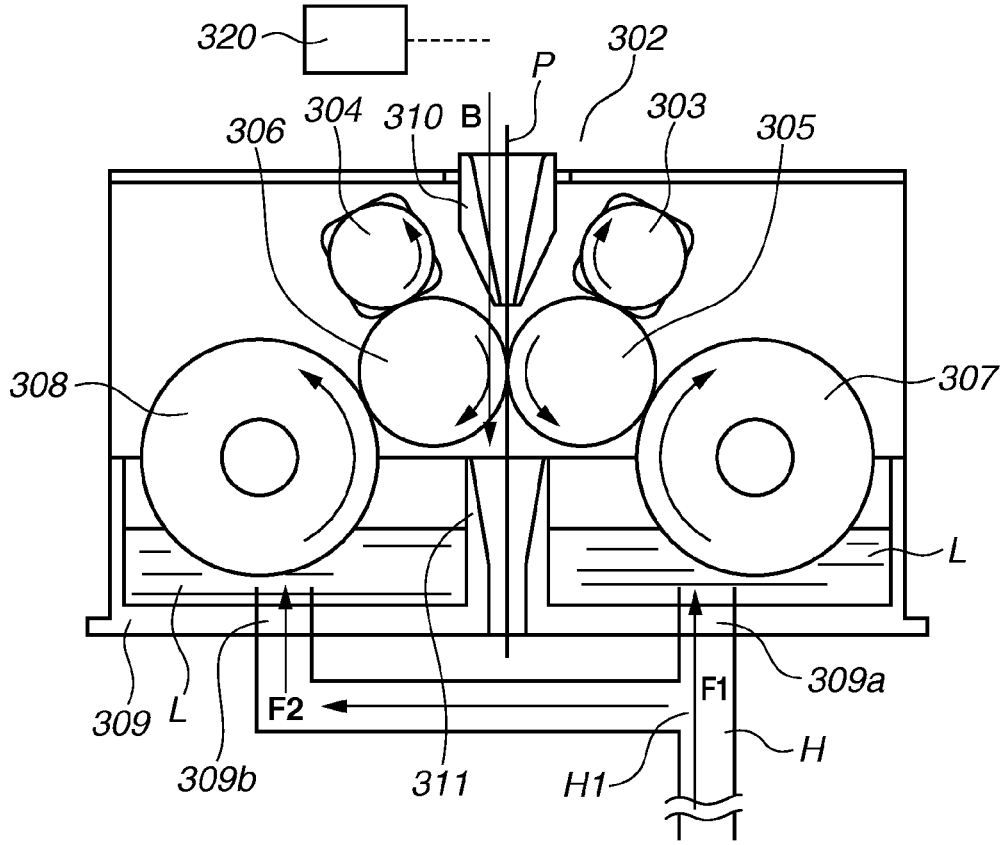
FIG. 4 is a cross-sectional view of a humidification device according to the first exemplary embodiment.

The humidification device 302 will be described below with reference to FIGS. 1, 4, 5, 6, 7A, 7B, and 8. FIG. 4 is a cross-sectional view of the humidification device 302. The humidification device 302 is provided for humidifying the sheet P for reducing the curling and waving of the sheet P.

The sheet P, conveyed in the direction indicated by the arrow B that is the same as the arrow B in FIG. 1, is guided by an inlet guide 310 to enter a nip portion formed by a pair of humidification rollers 305 and 306. The pair of humidification rollers 305 and 306 provides humidifying liquid L to surfaces (both surfaces) of the sheet P, whereby the sheet P is humidified.

The pair of humidification rollers 305 and 306 each are an elastic roller formed by forming a solid rubber layer on a surface of a shaft core. The solid rubber layer is composed mainly of nitrile rubber (NBR), silicon, and the like. The shaft core is formed of a metal rigid body formed of stainless steel and the like.

Water-supply rollers 307 and 308 sequentially supply the humidifying liquid L to the humidification rollers 305 and 306, and each are an elastic roller including a solid rubber layer on a surface of a shaft core. The shaft core is formed of a metal rigid body formed of stainless steel and the like. The solid rubber layer is composed mainly of a material such as NBR and the like that can achieve a hydrophilic surface on which the humidifying liquid can be held. The solid rubber layer may also be formed of metal, resin provided with hydrophilic treatment, or the like.

<Tank>

Figure 6:
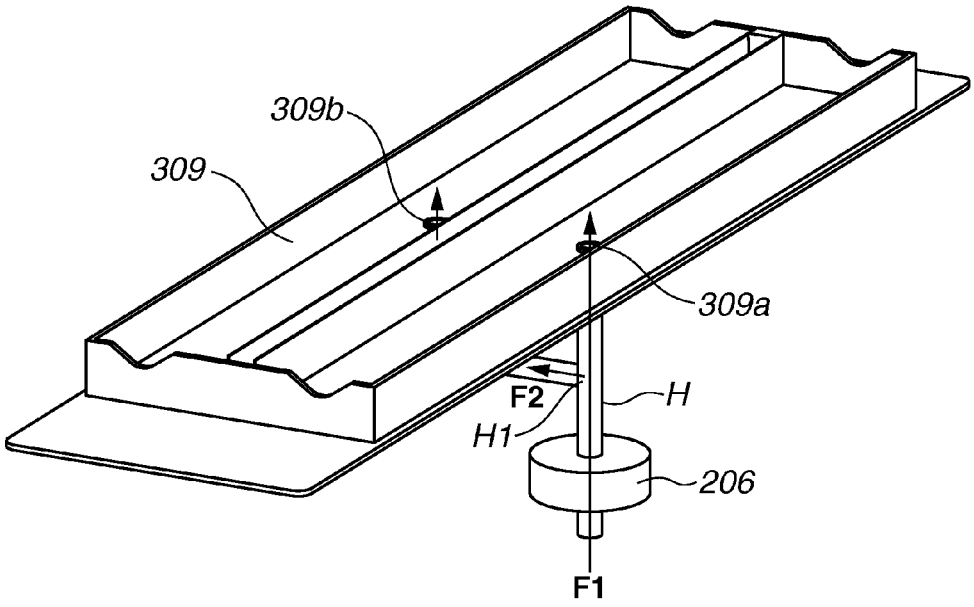
FIG. 6 is a diagram illustrating a water supply tank according to the first exemplary embodiment.

A water-storage tank, and supplying and discharging of the humidifying liquid L to and from the humidification device 302 are described with reference to FIGS. 1, 4, and 6. FIG. 6 is a diagram illustrating a portion around a water-supply tank.

A water-storage tank 204 in FIG. 1 stores the humidifying liquid L for humidifying the sheet P. The humidifying liquid L stored in the water-storage tank 204 is supplied to a water-supply tank (water-storage unit) 309 of the humidification device 302 as required. In the present exemplary embodiment, the humidifying liquid L is mainly composed of water, and also contains surfactant to achieve higher humidification efficiency and permeability of the sheet P.

The water-storage tank 204 is connected to the water-supply tank 309 disposed in the humidification device 302 via a water-supply pump 206 as illustrated in FIG. 4.

The humidifying liquid L accommodated in a water-supply pipe H is supplied to the water-supply tank 309 as appropriate by a pump (water-supply pump) 206 while being branched in directions indicated arrows F1 and F2 illustrated in FIGS. 4 and 6 at a branching portion H1 provided in the water-supply pipe H. The branched pipes of the water-supply pipe H are respectively coupled to water-supply holes 309*a* and 309*b* formed at bottom portions (substantially beneath the respective water-supply rollers 307 and 308) of the water-supply tank 309.

The water-supply rollers 307 and 308 each have a lower side portion immersed in the humidifying liquid L supplied by the pump 206 to be accumulated in the bottom portion of the water-supply tank 309 through the water-supply holes 309*a* and 309*b*. The water-supply rollers 307 and 308 rotate in directions illustrated in FIG. 4, respectively, to supply the humidifying liquid L to the humidification rollers 305 and 306. The humidifying liquid L is lifted up by an effect of its own viscosity, surface tension, and wettability of the rubber surface layers of the water-supply rollers 307 and 308.

The humidifying liquid L held on the surfaces of the water-supply rollers 307 and 308 is further provided to the surface layers of the humidification rollers 305 and 306, and at the same time, is scraped by scraping rollers 303 and 304. Thus, the humidifying liquid L is provided to the surface layers of the humidification rollers 305 and 306 with the uniformity maintained. The scraping rollers 303 and 304 are each formed of a material such as stainless steel or steel on which hard chromium plating is performed on a surface thereof, for example.

Figure 5:
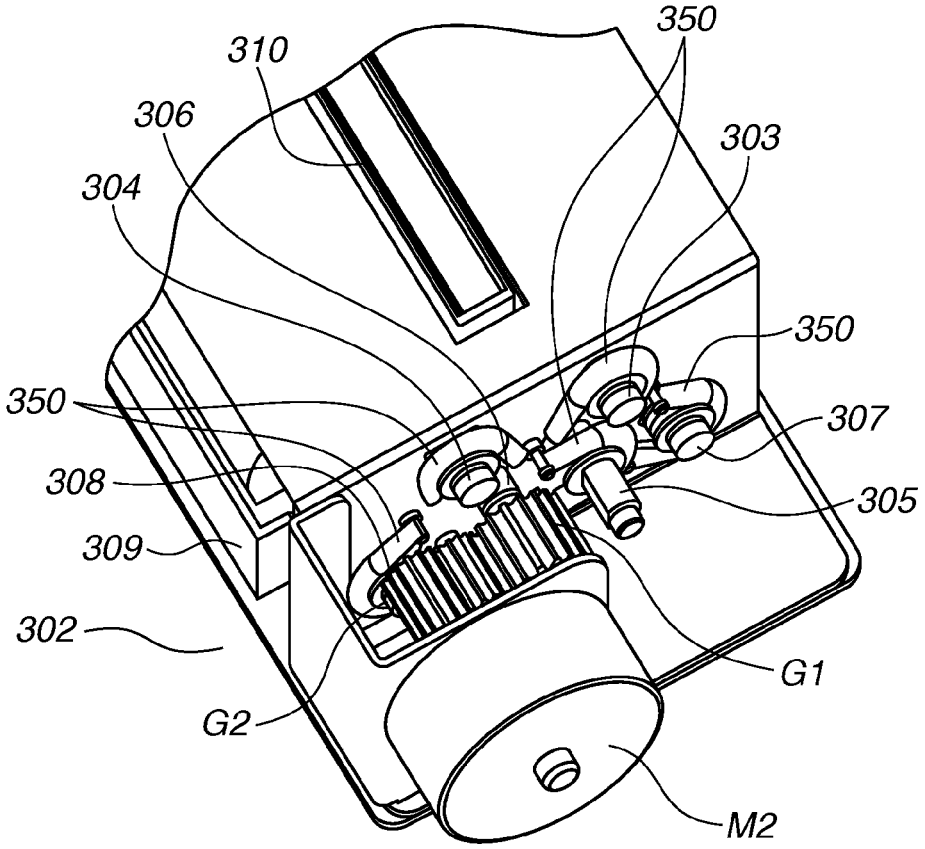
FIG. 5 is a perspective view of the humidification device according to the first exemplary embodiment.

As illustrated in FIG. 5, pressing springs 350, obtained by bending a tension coil spring into a U shape, apply pressure to (press) the humidification roller 305, the water-supply roller 308, and the scraping roller 304 toward the humidification roller 306, and apply pressure to (press) the water-supply roller 307 and the scraping roller 303 toward the humidification roller 305.

<Contact and Separation between Humidification Roller and Water-Supply Roller>

Figure 7A:
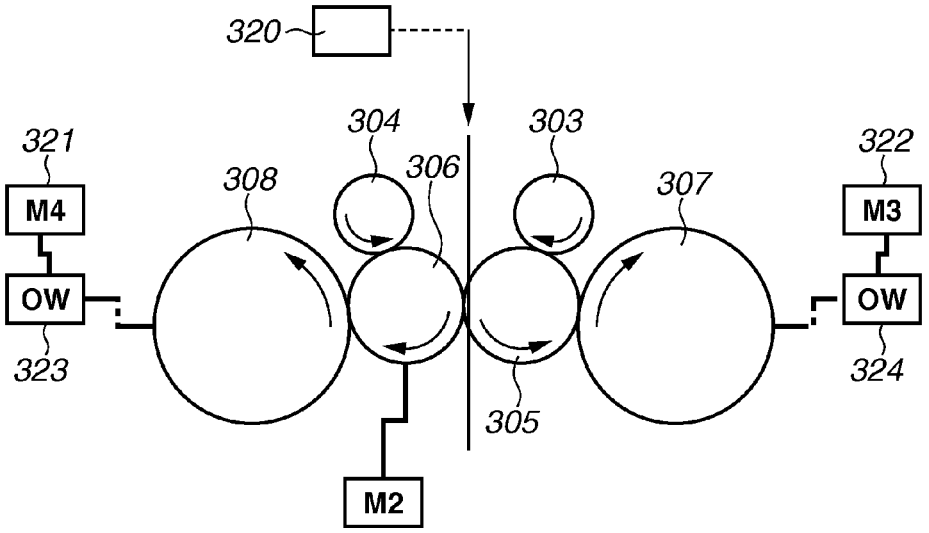
FIGS. 7A and 7B are diagrams illustrating contact and separation in the humidification device respectively in a contact state and a separate state according to the first exemplary embodiment.
Figure 7B:
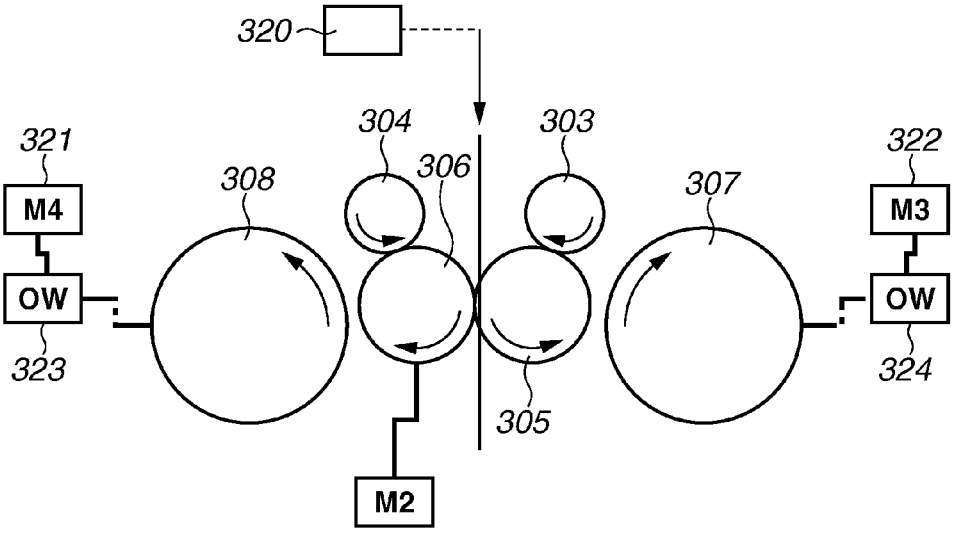

FIGS. 7A and 7B each are a block diagram illustrating a relative relationship between the humidification rollers 306 and 305 and the water-supply rollers 308 and 307.

FIG. 7A illustrates a contact state where the humidification rollers 305 and 306 are in contact with each other, and are respectively in contact with the water-supply rollers 307 and 308. In this state, the humidifying liquid L is supplied to the humidification rollers 305 and 306 respectively from the water-supply rollers 307 and 308. The humidification rollers 305 and 306 provide the humidifying liquid L to the sheet P.

FIG. 7B illustrates a separate state where the humidification rollers 305 and 306 are in contact with each other, but are respectively separated from the water-supply rollers 307 and 308. The control unit 200C switches the positional relationship between the humidification rollers 305 and 306 and the water-supply rollers 307 and 308 to the separate state when the humidification device 302 is in a standby state or in the idle state where the sheet P is not humidified.

An electromagnetic solenoid (switching unit) SL (FIG. 2) switches the positional relationship between the humidification rollers 305 and 306 and the water-supply rollers 307 and 308, between the contact state illustrated in FIG. 7A and the separate state illustrated in FIG. 7B. The solenoid SL moves the water-supply rollers 307 and 308 respectively away from the humidification rollers 305 and 306 against the pressing force of the pressing springs 350 (illustrated FIG. 5).

<Driving of Humidification Rollers>

How the humidification rollers 305 and 306 and the water-supply rollers 307 and 308 are driven in the state illustrated in FIG. 7A will be described.

A driving force input gear G1 for inputting driving force is fixed to one end of the humidification roller 306 as illustrated in FIG. 5. A drive motor M2 (humidification roller drive unit) is a driving source for generating the driving force for rotationally driving the driving force input gear G1. A drive gear G2 is fixed to a driving shaft of the drive motor M2. When the driving force input gear G1 meshes with the drive gear G2, the driving force from the drive motor M2 is transmitted to the driving force input gear G1.

When the humidification roller 306 is rotationally driven by the driving force from the drive motor M2 transmitted to the driving force input gear G1 as described above, all of the humidification roller 305, the water-supply rollers 307 and 308, and the scraping rollers 303 and 304, other than the humidification roller 306, are driven by the humidification roller 306 to rotate.

The sheet P that has entered the nip portion, formed by the pair of humidification rollers 305 and 306, to have the surfaces thereof provided with the humidifying liquid L, is guided by a sheet discharging guide 311 to be discharged from the humidification device 302.

<Driving of Water-supply Roller>

A method for driving the water-supply rollers 307 and 308 will be described with reference to FIG. 7B.

Drive motors M3 and M4 serve as driving sources that generate driving force for respectively rotating the water-supply rollers 307 and 308. Input gears 324 and 323 respectively input the driving force to the water-supply rollers 307 and 308. The input gears 323 and 324 each are rotatably supported by one end portion of the corresponding one of the water-supply rollers 307 and 308, via a one-way-clutch mechanism. The one-way-clutch mechanism transmits the driving force from the drive motors M3 and M4 to the water-supply rollers 307 and 308 via the input gears 324 and 323, respectively. Thus, the water-supply rollers 307 and 308 are rotationally driven.

With an operation of the one-way-clutch mechanism provided to each of the input gears 323 and 324, the driving force is not transmitted from the drive motors M3 and M4 to the water-supply rollers 307 and 308 in the state illustrated in FIG. 7A. In the state illustrated in FIG. 7A, the water-supply rollers 307 and 308 are driven by the rotation of the humidification rollers 305 and 306, which are rotated by the driving force from the drive motor M2, to rotate.

<Flowchart>

Figure 3:
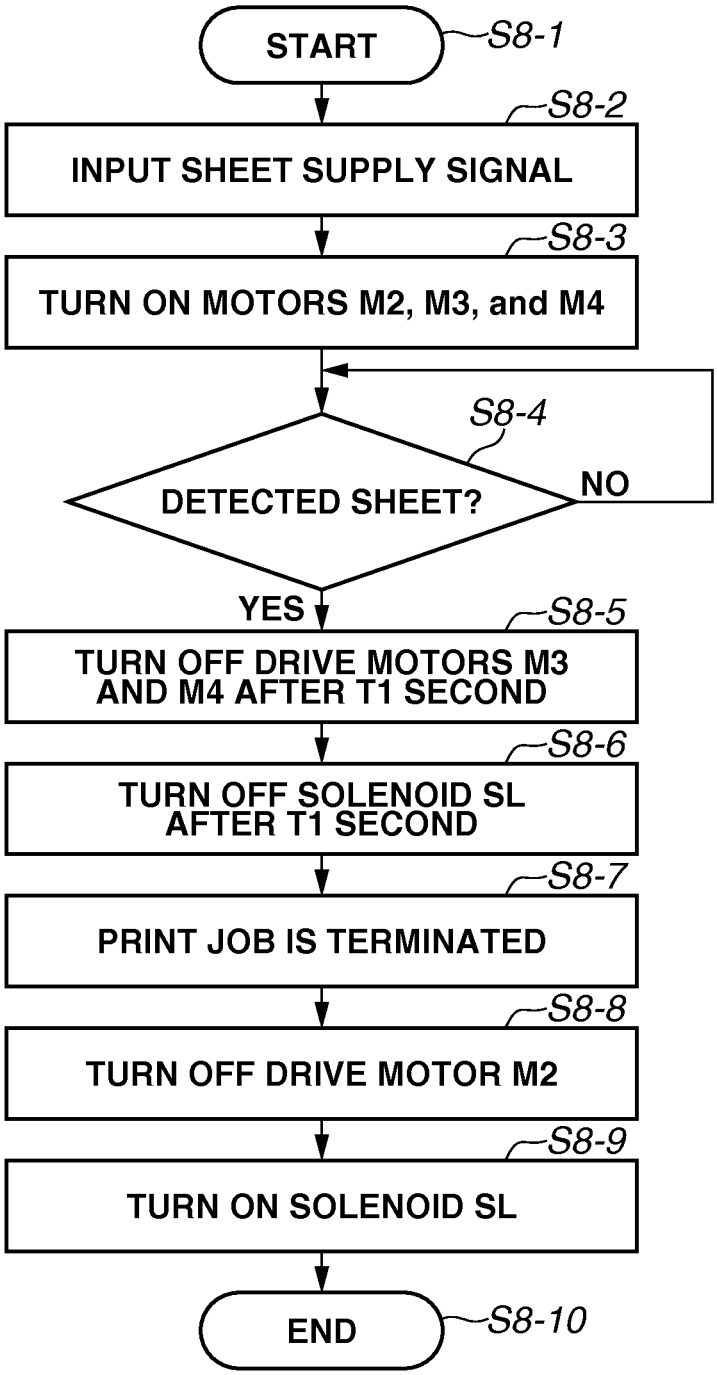
FIG. 3 is a flowchart illustrating a control according to the first exemplary embodiment.

FIG. 3 is a flowchart illustrating an operation of the humidification device 302.

The state transition between the states illustrated in FIGS. 7A and 7B will be described with reference to FIG. 3.

The humidification device 302 is in the state illustrated in FIG. 7B in an initial state in step S8-1. When a sheet supply signal is input to the CPU in step S8-2, the CPU turns on the drive motors M2, M3, and M4 in step S8-3. Thus, the water-supply rollers 307 and 308 and the pair of humidification rollers 305 and 306 independently rotate while the water-supply rollers 307 and 308 are respectively separated from the humidification rollers 305 and 306. In other words, the CPU rotates the water-supply rollers 307 and 308 in the state illustrated in FIG. 7B, before the sheet P, as the target of the humidification, reaches the nip portion formed by the pair of humidification rollers 306 and 307 to be humidified.

Then, the sheet P, on which the toner image has been transferred and fixed in the printer 500, is detected by a detection sensor 320 disposed on an upstream side of the humidification rollers 305 and 306. In step S8-4, the detection sensor 320 detects whether the leading edge of the sheet P has passed therethrough.

In step S8-5, the CPU turns off the drive motors M3 and M4 when T1 seconds have elapsed after the detection sensor 320 has detected the passing of the leading edge of the sheet P. In step S8-6, the CPU turns off the solenoid SL when T1 seconds have elapsed after the passing of the sheet P has been detected. As a result, in the humidification device 302, the water-supply rollers 307 and 308 respectively come into contact with the humidification rollers 305 and 306 (state transitions from FIG. 7B to FIG. 7A).

The sheet P enters the nip portion formed by the pair of humidification rollers 305 and 306 where the pair of humidification rollers 305 and 306 provides the humidifying liquid L to the surfaces of the sheet P.

Then, when a print job is terminated in step S8-7, the CPU turns off the drive motor M2 in step S8-8. In step S8-9, the CPU turns on the solenoid SL to move the water-supply rollers 307 and 308 away from the humidification rollers 305 and 306 (switch the state from FIG. 7A to FIG. 7B), whereby, in step S8-10, the processing is terminated.

The time T1 described above is set in accordance with a conveyance speed of the sheet P and a distance between the detection sensor 320 and the nip portion formed by the humidification rollers 305 and 306. More specifically, the time T1 is set in such a manner that the humidifying liquid L that has moved from the water-supply rollers 307 and 308 to the humidification rollers 305 and 306 reaches the nip portion before the sheet P reaches the nip portion.

According to the first exemplary embodiment described above, the water-supply rollers 307 and 308 can be rotationally driven independently while being separated from the humidification rollers 305 and 306. As a result, the amount of water on the water-supply rollers 307 and 308 can be kept uniform without the humidifying liquid L being accumulated in the nip portion formed by the humidification rollers 305 and 306, before the recording medium reaches the nip portion formed by the humidification rollers 305 and 306.

In the present exemplary embodiment described above, the humidification rollers 305 and 306 are also rotated while being separated from the water-supply rollers 307 and 308. However, the present invention is not limited to this configuration. In the first exemplary embodiment, not only the water-supply rollers 307 and 308 but also the humidification rollers 305 and 306 are rotated in the separate state. Thus, the humidifying liquid L can be uniformly distributed on the humidification rollers 305 and 306. Therefore, even when the humidifying liquid L is unevenly distributed on the humidification rollers 305 and 306 after the previous print job in which the humidifying liquid L is provided to the sheet P from the humidification rollers 305 and 306, the humidifying liquid L can be uniformly distributed on the humidification rollers 305 and 306 before the next sheet P arrives in the next print job.

In the present exemplary embodiment described above, the humidification rollers 305 and 306 are in contact with each other when the water-supply rollers 307 and 308 rotate before the sheet P reaches the nip portion formed by the pair of humidification rollers 306 and 307. However, the present invention is not limited to this configuration. The humidification rollers 305 and 306 may be separated from each other when the water-supply rollers 307 and 308 rotate. When the humidification rollers 305 and 306 are separated from each other, a timing at which the humidification rollers 305 and 306 come in contact with each other needs to be set so that the sheet P can be nipped by the humidification rollers 305 and 306.

(Modification)

In the first exemplary embodiment described above, an example where the water-supply roller 307 (308) and the humidification roller 305 (306) are separated from each other when the water-supply rollers 307 and 308 rotate before the sheet P reaches the nip portion formed by the pair of humidification rollers 305 and 306, is described. However, the present invention is not limited to this configuration.

Figure 8:
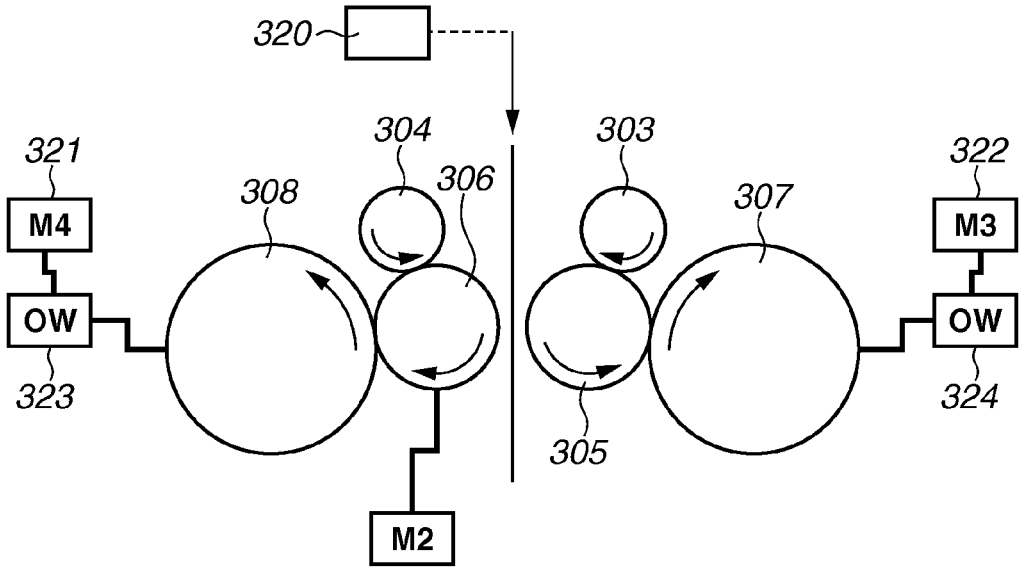
FIG. 8 is a diagram illustrating contact and separation of a humidification device according to another exemplary embodiment (separate state).

As illustrated in FIG. 8, the water-supply rollers 307 and 308 may rotate with the water-supply roller 307 (308) and the humidification roller 305 (306) being in contact with each other and the humidification rollers 305 and 306 being separated from each other.

The configuration of the present modification is the same as that of the first exemplary embodiment except for the contact and separate states between the water-supply roller 307 (308) and the humidification roller 305 (306) when the water-supply rollers 307 and 308 rotate. Thus, only the different part will be described.

Upon receiving the sheet supply signal, the CPU turns on the drive motors M2, M3, and M4. Thus, the water-supply rollers 307 and 308 independently rotate while the pair of humidification rollers 305 and 306 are separated from each other. In other words, the CPU rotates the water-supply rollers 307 and 308 in the state illustrated in FIG. 8 before the sheet P, as the target of the humidification, reaches the nip portion formed by the pair of humidification rollers 305 and 306 to be humidified. When the sheet P, on which the toner image has been transferred and fixed in the printer 500, is detected by the detection sensor 320, the humidification rollers 305 and 306 are switched from the separate state to the contact state before the sheet P reaches the nip portion formed by the pair of humidification rollers 305 and 306 (see FIG. 7A). Then, the sheet P enters the nip portion formed by the pair of humidification rollers 305 and 306 where the humidification rollers 305 and 306 supply the humidifying liquid L to the surfaces of the sheet P. The contact and separation mechanism for the pair of humidification rollers 305 and 306 may be implemented with a solenoid as in the first exemplary embodiment.

In the first exemplary embodiment and the modification described above, the configuration where the water-supply rollers 307 and 308 are moved away from the humidification rollers 305 and 306 by using the solenoid SL is described. However, the present invention is not limited to this configuration. The present invention may employ a configuration in which switching between the contact state and the separate state of the water-supply roller and the humidification roller is achieved with a cam as a switching unit, for example. Furthermore, the present invention may employ a configuration in which the humidification roller is moved away from the water-supply roller.

In the first exemplary embodiment and the modification described above, the two water-supply rollers 307 and 308 are disposed to respectively come into contact with the humidification rollers 305 and 306. However, the present invention is not limited to this configuration. More specifically, the present invention may employ a configuration where water is supplied to the pair of humidification rollers by a single water-supply roller as in Japanese Patent Application Laid-Open No. 2007-58026.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-010704, filed Jan. 23, 2014, and No. 2014-242590, filed Nov. 28, 2014, which are hereby incorporated by reference herein in their entirety.

What is claimed is:

1. A humidification device for humidifying a sheet, the humidification device comprising:

a pair of humidification rollers configured to come into contact with each other so as to form a nip portion, and configured to humidify the sheet which passes through the nip portion;

a liquid-supply roller configured to rotate while being in contact with one roller of the pair of humidification rollers so as to supply liquid to one roller of the pair of humidification rollers;

a switching unit which switches a positional relationship between one roller of the pair of humidification rollers and the liquid-supply roller between a separate state where one roller of the pair of humidification rollers and the liquid-supply roller are separated from each other and a contact state where one roller of the pair of humidification rollers and the liquid-supply roller are in contact with each other;

a detector located on the upstream side of the pair of humidification rollers and which detects the sheet;

a drive unit which rotates the liquid-supply roller; and a controller which controls the switching unit and the drive unit, wherein the controller controls the switching unit and the drive unit such that the liquid-supply roller rotates in the separate state and when the sheet is detected by the detector and a predetermined time has passed, the switching unit switches from the separate state to the contact state.

2. The humidification device according to claim 1, wherein the controller rotates the pair of humidification rollers while the pair of humidification rollers are in contact with each other in the separate state.

3. The humidification device according to claim 1, wherein the controller rotates the liquid-supply roller in the separate state before the sheet being conveyed reaches the nip portion formed by the pair of humidification rollers, and then switches the positional relationship between the liquid-supply roller and one roller of the pair of humidification rollers to the contact state.

4. The humidification device according to claim 1, further comprising another liquid-supply roller configured to come into contact with another roller of the pair of humidification rollers.

5. The humidification device according to claim 1, further comprising a liquid-storage which stores liquid to be supplied to the liquid-supply roller.

6. The humidification device according to claim 1, wherein the switching unit includes a solenoid.

7. The humidification device according to claim 1 wherein the controller rotates the liquid-supply roller one or more revolutions in the separate state.

8. An image forming apparatus comprising:

a transfer unit which transfers an image onto a sheet;

a fixing unit which fixes the image transferred by the transfer unit on the sheet; and a humidification device configured to humidify the sheet on which the image has been fixed by the fixing unit, wherein the humidification device includes:

a pair of humidification rollers configured to come into contact with each other so as to form a nip portion, and configured to humidify the sheet which passes through the nip portion;

a liquid-supply roller configured to rotate while being in contact with one roller of the pair of humidification rollers so as to supply liquid to one roller of the pair of humidification rollers;

a switching unit which switches a positional relationship between one roller of the pair of humidification rollers and the liquid-supply roller between a separate state where the one roller of pair of humidification rollers and the liquid-supply roller are separated from each other and a contact state where one roller of the pair of humidification rollers and the liquid-supply roller are in contact with each other;

a detector located on the upstream side of the pair of humidification rollers, configured to detect the sheet;

a drive unit which rotates the liquid-supply roller; and a controller configured to control the switching unit and the drive unit, wherein the controller controls the switching unit and the drive unit such that the liquid-supply roller rotates in the separate state and when the sheet is detected by the detector and a predetermined time has passed, the switching unit switches from the separate state to the contact state.

9. The image forming apparatus according to claim 8 wherein the controller rotates the liquid-supply roller one or more revolutions in the separate state.

10. A humidification device for humidifying a sheet, the humidification device comprising:

a pair of humidification rollers configured to come into contact with each other so as to form a nip portion, and configured to humidify the sheet which passes through the nip portion;

a liquid-supply roller configured to rotate while being in contact with one roller of the pair of humidification rollers so as to supply liquid to one roller of the pair of humidification rollers;

a switching unit which switches a positional relationship between the pair of humidification rollers between a separate state where the pair of humidification rollers are separated from each other and a contact state where the pair of humidification rollers are in contact with each other;

a detector located on the upstream side of the pair of humidification rollers, configured to detect the leading edge of the sheet;

a drive unit which rotates the liquid-supply roller; and a controller configured to control the switching unit and the drive unit, wherein the controller controls the switching unit and the drive unit such that the liquid-supply roller rotates in the separate state and when the sheet is detected by the detector and a predetermined time has passed, the switching unit switches from the separate state to the contact state.

11. The humidification device according to claim 10, wherein the controller rotates the liquid-supply roller in the separate state where the pair of humidification rollers are separated from each other before the sheet being conveyed reaches the nip portion formed by the pair of humidification rollers, and then switches the positional relationship between the pair of humidification rollers to the contact state.

12. The humidification device according to claim 10, further comprising another liquid-supply roller configured to come into contact with another roller of the pair of humidification rollers.

13. The humidification device according to claim 10, further comprising a liquid-storage which stores liquid to be supplied to the liquid-supply roller.

14. The humidification device according to claim 10, wherein the switching unit includes a solenoid.

15. The humidification device according to claim 10 wherein the controller rotates the liquid-supply roller one or more revolutions in the separate state.

16. An image forming apparatus comprising:

a transfer unit which transfers an image onto a sheet;

a fixing unit which fixes the image transferred by the transfer unit on the sheet; and a humidification device configured to humidify the sheet on which the image has been fixed by the fixing unit, wherein the humidification device includes:

a pair of humidification rollers configured to come into contact with each other so as to form a nip portion, and configured to humidify the sheet which passes through the nip portion;

a liquid-supply roller configured to rotate while being in contact with one roller of the pair of humidification rollers so as to supply liquid to one roller of the pair of humidification rollers;

a switching unit which switchs a positional relationship between the pair of humidification rollers between a separate state where the pair of humidification rollers are separated from each other and a contact state where the pair of humidification rollers are in contact with each other;

a detector located on the upstream side of the pair of humidification rollers, configured to detect the leading edge of the sheet;

a drive unit which rotates the liquid-supply roller; and a controller configured to control the switching unit and the drive unit, wherein the controller controls the switching unit and the drive unit such that the liquid-supply roller rotates in the separate state and when the sheet is detected by the detector and a predetermined time has passed, the switching unit switches from the separate state to the contact state.

17. The image forming apparatus according to claim 16 wherein the controller rotates the liquid-supply roller one or more revolutions in the separate state.

* * * * *